US011058141B2

(12) United States Patent
Sanna et al.

(10) Patent No.: US 11,058,141 B2
(45) Date of Patent: Jul. 13, 2021

(54) METHOD AND APPARATUS FOR MANUFACTURING INDUCTIVELY HEATABLE AEROSOL-FORMING RODS

(71) Applicant: PHILIP MORRIS PRODUCTS S.A., Neuchatel (CH)

(72) Inventors: Daniele Sanna, Marin-Epagnier (CH); Ivan Prestia, Longara di Calderara di Reno (IT); Christian Agostini, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 40 days.

(21) Appl. No.: 16/498,522

(22) PCT Filed: Jun. 13, 2018

(86) PCT No.: PCT/EP2018/065567
§ 371 (c)(1),
(2) Date: Sep. 27, 2019

(87) PCT Pub. No.: WO2018/229087
PCT Pub. Date: Dec. 20, 2018

(65) Prior Publication Data

US 2020/0107571 A1 Apr. 9, 2020

(30) Foreign Application Priority Data

Jun. 15, 2017 (EP) ..... 17176239

(51) Int. Cl.
*A24C 5/18* (2006.01)
*A24B 3/14* (2006.01)
(Continued)

(52) U.S. Cl.
CPC ..... *A24B 3/14* (2013.01); *A24C 5/01* (2020.01); *A24C 5/1821* (2013.01); *A24D 1/20* (2020.01)

(58) Field of Classification Search
CPC ..... A24C 5/01; A24C 5/1821; A24B 3/14; A24D 1/20
See application file for complete search history.

(56) References Cited

U.S. PATENT DOCUMENTS

2015/0107611 A1 4/2015 Metrangolo
2015/0181938 A1 7/2015 Metrangolo
2016/0295926 A1* 10/2016 Zuber ..... A24F 40/40

FOREIGN PATENT DOCUMENTS

EP 2893820 7/2015
WO WO 2013/178768 12/2013
(Continued)

OTHER PUBLICATIONS

PCT Search Report and Written Opinion for PCT/EP2018/065567 dated Aug. 9, 2018 (9 pages).
(Continued)

*Primary Examiner* — Eric Yaary
(74) *Attorney, Agent, or Firm* — Mueting Raasch Group

(57) ABSTRACT

The present invention relates to a method for manufacturing inductively heatable aerosol-forming rods (100). The method comprises supplying a first substrate web (31) and a second substrate web (32) separately to a continuous multiple-stage rod-forming process which comprises at least a first and a subsequent second stage. The method further comprises supplying a continuous susceptor profile (20) to the rod-forming process such that the susceptor profile passes through at least the second stage. Furthermore, the method comprises passing the first and second substrate web separately through the first stage. Thereby, the first and the second substrate web are separately pre-gathered trans-
(Continued)

Figure 1:
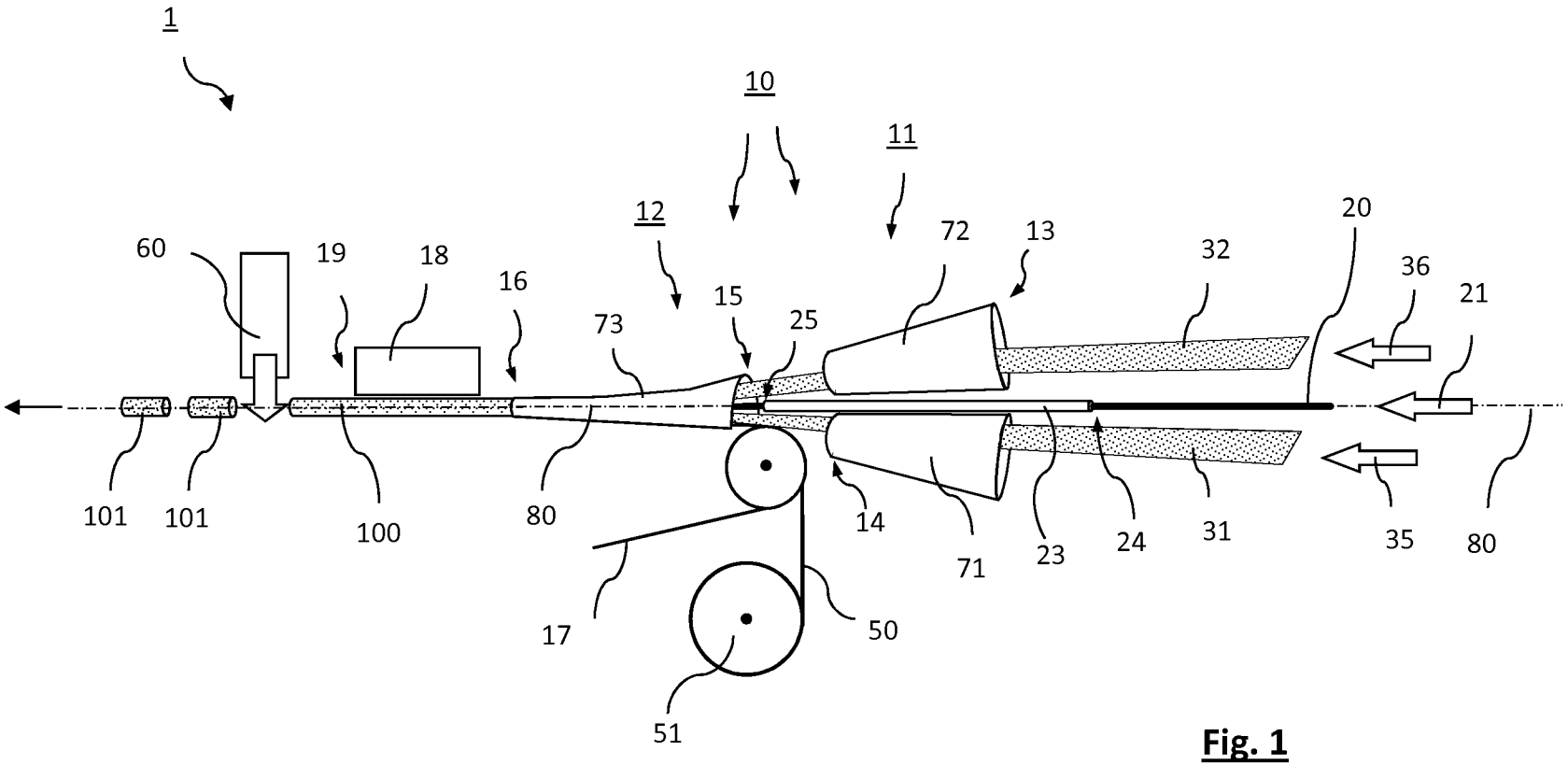

versely with regard to a respective transport direction of each of the substrate web through the first stage. The method further comprises passing the susceptor profile and the pre-gathered substrate webs through the second stage. Thereby, the separately pre-gathered substrate webs are jointly gathered into a rod shape around the susceptor profile. The invention further relates to a multi-stage rod-forming device (10) comprising at least a first stage (11) and a second stage (12) downstream of the first stage. The first stage is configured for separately pre-gathering a first and a second substrate web (31, 32) respectively as each of them passes through the first stage. The second stage is configured for jointly gathering the pre-gathered substrate webs into a rod shape around a susceptor profile (20) as the susceptor profile and the pre-gathered substrate webs pass through the second stage.

15 Claims, 3 Drawing Sheets

(51) Int. Cl.
*A24C 5/01* (2020.01)
*A24D 1/20* (2020.01)

(56) References Cited

FOREIGN PATENT DOCUMENTS

| | | |
|---|---|---|
| WO | WO 2015/082652 | 6/2015 |
| WO | WO 2015/177252 | 11/2015 |
| WO | WO 2015/177294 | 11/2015 |
| WO | WO 2016/184928 | 11/2016 |
| WO | WO 2016/184929 | 11/2016 |
| WO | WO 2017/068091 | 4/2017 |
| WO | 2018/122320 | 7/2018 |

OTHER PUBLICATIONS

Office Action issued in Europe for Application No. 18729982.1 dated Apr. 23, 2021 (4 pages).

* cited by examiner

METHOD AND APPARATUS FOR MANUFACTURING INDUCTIVELY HEATABLE AEROSOL-FORMING RODS

This application is a U.S. National Stage Application of International Application No. PCT/EP2018/065567 filed Jun. 13, 2018, which was published in English on Dec. 20, 2018 as International Publication No. WO 2018/229087 A1. International Application No. PCT/EP2018/065567 claims priority to European Application No. 17176239.6 filed Jun. 15, 2017.

The present invention relates to a method and an apparatus for manufacturing inductively heatable aerosol-forming rods for use in an aerosol-generating system.

Aerosol-generating systems based on inductively heating an aerosol-forming substrate are generally known from prior art. These systems comprise an induction source for generating an alternating electromagnetic field which induces at least one of heat generating eddy currents or hysteresis losses in a susceptor. The susceptor in turn is in thermal proximity of an aerosol-forming substrate which is capable to form an inhalable aerosol upon heating. In particular, the susceptor may be an integral part of a rod-shaped aerosol-forming article. The article comprises the aerosol-forming substrate to be heated and is configured for interaction with an aerosol-generating device comprising the induction source. However, positioning of the susceptor within the substrate of the aerosol-forming rod requires special care as an accurate positioning is crucial for an adequate heating of the substrate and thus for an adequate aerosol formation.

Therefore, it would be desirable to have a reliable method and apparatus for manufacturing inductively heatable aerosol-forming rods including an accurately positioned susceptor.

According to the invention there is provided a method for manufacturing inductively heatable aerosol-forming rods. The method comprises the step of supplying a first substrate web and a second substrate web separately to a continuous multiple-stage rod-forming process. The multiple-stage rod-forming process comprises at least a first and a subsequent second stage. The method further comprises the step of supplying a continuous susceptor profile to the rod-forming process such that the susceptor profile passes through at least the second stage. Furthermore, the method comprises the step of passing the first and second substrate web separately through the first stage. Thereby, the first and the second substrate web are separately pre-gathered in a transverse direction with respect to a respective transport direction of the first and second substrate web through the first stage. The method further comprises the step of passing the susceptor profile and the pre-gathered first and second substrate web through the second stage. Thereby, the separately pre-gathered first and second substrate webs are jointly gathered into a rod shape around the susceptor profile.

The method according to invention proves advantageous with regard to several aspects. Supplying the substrate material to the rod-forming process at least in two parts, that is, in form of at least a first and a second substrate web, advantageously allows for pre-distributing the substrate material around the susceptor profile. This in turn positively affects the subsequent step of gathering the substrate material around the susceptor profile in the second stage. In particular, pre-distributing the substrate material facilitates to gather the substrate material substantially symmetrically around the susceptor profile. A substantially symmetric distribution of the substrate material around the susceptor profile is desirable with regard to a homogeneous, in particular symmetric and reproducible heating of the substrate material.

Having the first and second substrate web pre-gathered prior to being gathered around the susceptor profile causes friction effects and a resistance to compression of the substrate material to be less pronounced in the second stage, that is, during the actual rod-forming process. Advantageously, reduced friction effects and a reduced resistance to compression not only increase the overall efficiency of the rod-forming process but also facilitate an accurate positioning of the susceptor at a pre-defined position within the aerosol-forming rod. In particular, as compared to non-gathered substrate material the pre-gathered first and second substrate webs exert less adverse displacement forces to the susceptor profile in the second stage due to the reduced resistance to compression. Advantageously, this ensures that there is little or essentially no divergence of the susceptor profile from its desired position. In addition, this also reduces the risk of plastic deformations of the susceptor profile.

Pre-gathering the first and second substrate web prior to gathering both substrate webs around the susceptor profile allows for providing a supporting embedding of the susceptor profile by the pre-gathered substrate material. Advantageously, this supporting embedding facilitates to preserve a desired position of the susceptor profile as passing through the second stage.

Preferably, the method according to the invention may be performed by using an apparatus for manufacturing inductively heatable aerosol-forming rods according to the invention and as described herein.

As used herein, the term 'substrate web' refers to a continuous substrate web comprising an aerosol-forming substrate. As further used herein, the term 'aerosol-forming substrate' denotes a substrate formed from or comprising an aerosol-forming material that is capable of releasing volatile compounds upon heating for generating an aerosol. The aerosol-forming substrate is intended to be heated rather than combusted in order to release the aerosol-forming volatile compounds. Preferably, the aerosol-forming substrate is an aerosol-forming tobacco substrate, that is, a tobacco containing substrate. The aerosol-forming substrate may contain volatile tobacco flavor compounds, which are released from the substrate upon heating. The aerosol-forming substrate may comprise or consist of blended tobacco cut filler or may comprise homogenized tobacco material. Homogenized tobacco material may be formed by agglomerating particulate tobacco. The aerosol-forming substrate may additionally comprise a non-tobacco material, for example homogenized plant-based material other than tobacco.

Preferably, the aerosol-forming substrate may comprise a tobacco web, preferably a crimped web. The tobacco web may comprise tobacco material, fiber particles, a binder material and an aerosol former. Preferably, the tobacco sheet is cast leaf. Cast leaf is a form of reconstituted tobacco that is formed from a slurry including tobacco particles, fiber particles, aerosol former, binder and for example also flavors. Tobacco particles may be of the form of a tobacco dust having particles in the order of 30 micrometers to 250 micrometers, preferably in the order of 30 micrometers to 80 micrometers or 100 micrometers to 250 micrometers, depending on the desired sheet thickness and casting gap. The casting gap influences the thickness of the sheet. Fiber particles may include tobacco stem materials, stalks or other tobacco plant material, and other cellulose-based fibers such as for example wood fibers, preferably wood fibers. Fiber particles may be selected based on the desire to produce a sufficient tensile strength for the cast leaf versus a low inclusion rate, for example, an inclusion rate between approximately 2 percent to 15 percent. Alternatively, fibers, such as vegetable fibers, may be used either with the above fiber particles or in the alternative, including hemp and bamboo. Aerosol formers included in the slurry forming the cast leaf or used in other aerosol-forming tobacco substrates may be chosen based on one or more characteristics. Functionally, the aerosol former provides a mechanism that allows it to be volatilized and convey nicotine or flavoring or both in an aerosol when heated above the specific volatilization temperature of the aerosol former. Different aerosol formers typically vaporize at different temperatures. The aerosol-former may be any suitable known compound or mixture of compounds that, in use, facilitates formation of a stable aerosol. A stable aerosol is substantially resistant to thermal degradation at the operating temperature for heating the aerosol-forming substrate. An aerosol former may be chosen based on its ability, for example, to remain stable at or around room temperature but able to volatize at a higher temperature, for example, between 40 degree Celsius and 450 degree Celsius.

The aerosol former may also have humectant type properties that help maintain a desirable level of moisture in an aerosol-forming substrate when the substrate is composed of a tobacco-based product, particularly including tobacco particles. In particular, some aerosol formers are hygroscopic material that functions as a humectant, that is, a material that helps keep a tobacco substrate containing the humectant moist.

One or more aerosol formers may be combined to take advantage of one or more properties of the combined aerosol formers. For example, triacetin may be combined with glycerin and water to take advantage of the triacetin's ability to convey active components and the humectant properties of the glycerin.

Aerosol formers may be selected from the polyols, glycol ethers, polyol ester, esters, and fatty acids and may comprise one or more of the following compounds: glycerin, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

The aerosol-forming substrate may comprise other additives and ingredients, such as flavourants. The aerosol-forming substrate preferably comprises nicotine and at least one aerosol-former. The susceptor being in thermal proximity of or in thermal or physical contact with the aerosol-forming substrate allows for an efficient heating.

A tobacco sheet according to the invention, for example a cast leaf, may have a thickness in a range of between about 0.05 millimeter and about 0.5 millimeter, preferably between about 0.08 millimeter and about 0.2 millimeter, and most preferably between about 0.1 millimeter and about 0.15 millimeter.

As used herein, the term 'continuous susceptor profile' either refers to an endless susceptor profile or a to a susceptor profile of a minimum length, for example of at least 1 meter, in particular of at least 2 meters, preferably, of at least 5 meters.

As further used herein, the term 'susceptor profile' refers to an element comprising a material that is capable of being inductively heated within an alternating electromagnetic field. This may be the result of at least one of hysteresis losses or eddy currents induced in the susceptor, depending on the electrical and magnetic properties of the susceptor material. Hysteresis losses occur in ferromagnetic or ferrimagnetic susceptors due to magnetic domains within the material being switched under the influence of an alternating electromagnetic field. Eddy currents may be induced if the susceptor is electrically conductive. In case of an electrically conductive ferromagnetic susceptor or an electrically conductive ferrimagnetic susceptor, heat can be generated due to both, eddy currents and hysteresis losses.

The susceptor profile may be formed from any material that can be inductively heated to a temperature sufficient to generate an aerosol from the aerosol-forming substrate. Preferred susceptor profiles comprise a metal or carbon. A preferred susceptor profile may comprise or consist of a ferromagnetic material, for example a ferromagnetic alloy, ferritic iron, or a ferromagnetic steel or stainless steel. Another suitable susceptor profile may be, or comprise, aluminum. Preferred susceptor profiles may be heated to a temperature in excess of 250 degrees Celsius. The susceptor profile may also comprise a non-metallic core with a metal layer disposed on the non-metallic core, for example metallic tracks formed on a surface of a ceramic core. According to another example, the susceptor profile may have a protective external layer, for example a protective ceramic layer or protective glass layer encapsulating the susceptor profile. The susceptor may comprise a protective coating formed by a glass, a ceramic, or an inert metal, formed over a core of susceptor material.

The susceptor profile may be a multi-material susceptor. In particular, the susceptor profile may comprise a first susceptor material and a second susceptor material. The first susceptor material preferably is optimized with regard to heat loss and thus heating efficiency. For example, the first susceptor material may be aluminum, or a ferrous material such as a stainless steel. In contrast, the second susceptor material preferably is used as temperature marker. For this, the second susceptor material is chosen such as to have a Curie temperature corresponding to a predefined heating temperature of the susceptor assembly. At its Curie temperature, the magnetic properties of the second susceptor change from ferromagnetic to paramagnetic, accompanied by a temporary change of its electrical resistance. Thus, by monitoring a corresponding change of the electrical current absorbed by the induction source it can be detected when the second susceptor material has reached its Curie temperature and, thus, when the predefined heating temperature has been reached. The second susceptor material preferably has a Curie temperature that is below the ignition point of the aerosol-forming substrate, that is, preferably lower than 500 degrees Celsius. Suitable materials for the second susceptor material may include nickel and certain nickel alloys.

The susceptor profile may be a filament, a rod, or a sheet, in particular a band. The susceptor profile may have a constant cross-section. The susceptor profile may have an oval or elliptical or circular or square or rectangular or triangular or polygonal cross-section, like, for example a cross-section that has the form of the roman letters "T", "X", "U", "C" or "I" (with or without serif). In case of a circular cross-section, the susceptor profile preferably has a width or diameter of between about 1 millimeter and about 5 millimeter. If the susceptor profile has the form of a sheet, the sheet preferably has a rectangular shape. In this case, the susceptor profile preferably has a width dimension that is greater than a thickness dimension, for example greater than twice a thickness dimension. Advantageously, a sheet-like susceptor profile has a width preferably between about 2 millimeter and about 8 millimeter, more preferably, between about 3 millimeter and about 5 millimeter, and a thickness preferably between about 0.03 millimeter and about 0.15 millimeter, more preferably between about 0.05 millimeter and about 0.09 millimeter.

According to a preferred aspect of the invention the step of passing the susceptor profile through the second stage comprises passing the susceptor profile through the second stage at least partially, preferably entirely along a center axis of the second stage. Advantageously, this causes the susceptor to be accurately positioned at its desired final position within the aerosol-generating rod, that is, coaxially to or on-axis with the center axis of the aerosol-generating rod.

For this, the susceptor profile may be positioned along the center axis of the rod forming process. Preferably, the susceptor profile is positioned along the center axis upstream of the second stage. Likewise, the susceptor profile may be positioned along the center axis upstream of or prior to getting into contact with the substrate web. Accordingly, the step of supplying the susceptor profile to the rod-forming process may comprise positioning the susceptor profile to the rod-forming process such as to enter and pass through the second stage at least partially along a center axis of the second stage of the rod forming process.

When the susceptor passes through, and preferably already enters the second stage along the center axis of the second stage, the susceptor profile defines a physical center for the rod-forming process which the first and second substrate webs are coaxially gathered around. Accordingly, the center axis of the second stage preferably defines a center axis of the final aerosol-generating rod resulting from the rod-forming process. Advantageously, this causes the rod-forming process to be reliable and reproducible with regard to an accurate center position of the susceptor within the surrounding substrate.

The center axis of the second stage of the rod-forming process preferably is a straight axis. Alternatively, at least a section of the center axis may be curved.

According to another aspect of the invention, the step of supplying the susceptor profile to the rod-forming process comprises supplying the susceptor profile such that the first and second substrate web enter the second stage of the rod-forming process laterally to the susceptor profile. Preferably, the step of supplying the susceptor profile to the rod-forming process comprises supplying the susceptor profile such as to enter the second stage between the first and the second substrate web. That is, the first and the second substrate web preferably enter the second stage laterally to the susceptor profile at opposite sides of the susceptor profile. In this arrangement, the susceptor profile is advantageously sandwiched between the first and the second substrate web.

As used herein, the term 'enter the second stage laterally to the susceptor profile' may include 'enter the second stage alongside the susceptor profile', in particular 'enter the second stage alongside the susceptor profile at an angle between zero degrees and 50 degrees, in particular between zero degrees and 30 degrees, preferably between zero degrees and 20 degrees with regard to a transport direction of the susceptor profile'. Accordingly, in case the susceptor profile enters the second stage along the center axis of the second stage, the first and the second substrate web do not enter the second stage on-axis, but off-axis with regard to the center axis. According to a particular example, each of the first and the second substrate web may enter the second stage from a side towards the susceptor profile, that is, at an angle greater than zero degrees with regard to a transport direction of the susceptor profile, in particular to the center axis of the second stage. Alternatively, the substrate web may enter the second stage parallel to the susceptor profile, that is, at an angle of zero degrees to a transport direction of the susceptor profile, in particular to the center axis of the second stage.

In any case, having the first and second substrate webs entering the second stage laterally to the susceptor profile advantageously allows for an undisturbed positioning of the susceptor profile prior to surrounding the susceptor profile with the aerosol-forming substrate in the second stage. Advantageously, this prevents the susceptor from being displaced from its desired final position and ensures that there is little or essentially no divergence of the susceptor from a possible positioning at entering and passing through the second stage. In addition, having the aerosol-forming substrate entering the second stage laterally to the susceptor profile is also favorable to facilitate gathering the first substrate web and the second substrate web coaxially around the susceptor.

In general, the first and the second substrate web may be supplied such as to enter the second stage on either side of the susceptor profile, yet preferably at opposite sides of the susceptor profile. Most preferably, either the first or the second substrate web is arranged below the susceptor profile at least when entering the second stage. Advantageously, having one of the first or the second substrate web arranged below the susceptor profile enables the substrate web to support the susceptor profile as both pass through the second stage. This in turn facilitates to keep a stable position of the susceptor profile along the center axis.

In particular, the step of supplying the first and second substrate web separately to the multiple-stage rod-forming process may comprise supplying the first and second substrate web to the rod-forming device such as to enter and pass through the first and second stage in succession.

Moreover, the step of supplying the first and second substrate web separately to the multiple-stage rod-forming process may comprise supplying each of the first and the second substrate web such as to be arranged substantially horizontally prior to being gathered or pre-gathered. That is, a respective large or flat side of the first and second substrate web is substantially co-planar to a horizontal plane. This also proves advantageous for supporting the susceptor profile as passing through the rod-forming process.

According to another preferred aspect of the invention, the step of supplying the susceptor profile to the rod-forming process comprises supplying the susceptor profile such as to enter and pass through the first and the second stage in succession. Advantageously, having the susceptor profile to pass both, the first and the second stage facilitates to position the susceptor profile prior to entering the second stage, that is, upstream of the second stage. In particular, this may facilitate to position of the susceptor as passing through the first stage and preferably even prior to entering the first stage, that is, upstream of the first stage. This in turn proves advantageous with regard to an accurate position of the susceptor profile in the final aerosol-forming rod.

Preferably, the step of supplying the susceptor profile to the rod-forming process comprises supplying the susceptor profile such as to enter and pass through the first stage without contact to the first and the second substrate webs prior to passing through the second stage. In particular, the susceptor may be unprocessed as passing through the first stage. Having the susceptor profile without contact to the first and second substrate web as passing through the first stage facilitates to reduce adverse friction effects of the overall rod-forming process. In particular, this allows keeping away the susceptor profile from pressure of the first and second substrate web until entering the second stage. Further, this ensures that there is little or essentially no divergence of the susceptor from a possible positioning as entering and passing through the second stage. In addition, this also reduces the risk of plastic deformations of the susceptor profile. Alternatively, the step of supplying the susceptor profile to the rod-forming process may comprise supplying the susceptor profile to the rod-forming process such as to enter and pass through the second stage only. That is, the susceptor profile may be supplied to the rod-forming process downstream the first stage.

Preferably, the susceptor profile is dimensionally stable. For this, the shape and material of the susceptor profile may be chosen such as to ensure sufficient dimensional stability. Advantageously, this assures that a desired heating profile of the susceptor is preserved throughout the rod-forming process which in turn reduces the variability of the product performance. Accordingly, the step of gathering the substrate web around the susceptor profile is performed such that the susceptor profile substantially remains undeformed after passing through at the rod-forming process, in particular the second stage. This means, that preferably, any deformation of the susceptor profile remains elastic, such that the susceptor profile returns to its intended shape when a deforming force is removed.

According to another preferred aspect of the invention, the method may comprise longitudinally guiding the susceptor profile, in particular at least along a section of the rod-forming process, preferably along at least an upstream section of the second stage of the rod-forming process. Accordingly, the susceptor profile may be longitudinally guided at least along 25 percent, in particular at least along 50 percent, preferably at least along 75 percent, more preferably at least along 90 percent or along 100 percent of a length of the entire rod-forming process. The length of the rod-forming process corresponds to a path length of a process path through the rod-forming process. In particular, the susceptor profile is longitudinally guided downstream from an upstream end of the rod-forming process. Advantageously, longitudinally guiding at least along a section of the rod-forming process supports positioning the susceptor profile along a center axis of the second stage and at the same time prevents the susceptor profile from being displaced from a desired position prior to being sufficiently embedded in the surrounding aerosol-forming substrate.

The susceptor may be longitudinally guided along at least an upstream section of the second stage. In addition, the susceptor profile may be guided also upstream of the second stage. In particular, the susceptor profile may be longitudinally guided along at least a section of the first stage. Likewise, the susceptor profile may be also longitudinally guided upstream of the overall rod-forming process, that is upstream of the first stage. Longitudinally guiding upstream of the second stage facilitates a possible positioning of the susceptor profile along a center axis of the second stage prior to entering the second stage. Advantageously, this enhances positioning accuracy of the susceptor profile at its desired final position within the aerosol-generating rod.

Preferably, the susceptor profile is unguided at a downstream end of the upstream section of the second stage or further downstream of the upstream section of the second stage, that is, in a downstream section of the second stage.

The step of longitudinally guiding the susceptor profile may be part of at least one of the steps of supplying the susceptor profile to the rod-forming process and passing the susceptor profile through the rod-forming process.

Guiding of the susceptor profile may be accomplished by providing a longitudinal guide, for example a tubular guide. The longitudinal guide may comprise a guiding profile, in particular a longitudinal guiding profile for longitudinally guiding the susceptor profile. A cross-section of the guiding profile, for example an inner cross-sectional profile of a tubular guide, preferably corresponds to a cross-section, that is, to an outer cross-section of the susceptor profile. Accordingly, the cross-section of a guiding profile of the longitudinal guide may be oval, elliptical, circular, square, rectangular, triangular or polygonal. Advantageously, having corresponding cross-sections facilitates to maintain the position of the susceptor profile, in particular the rotational position of the susceptor profile. Thus, the longitudinal guide may particularly serve as rotation lock protecting the susceptor profile against twisting or torsion, or, if needed, to guide the susceptor profile along a twisted path in transport direction.

As used herein, the term 'upstream section of the second stage' refers to a first section of the second stage in which the substrate web is at least partially gathered or even fully gathered around the susceptor profile but has not yet achieved the final rod shape. In particular, upon passing the upstream section of the second stage, the substrate web is at least partially gathered in a loose arrangement. In this context, "loose" indicates that the substrate web has, at that point, not yet been gathered into the final, more condensed form. The at least partially gathered substrate web may be of any form or shape, in particular of a rod shape, however with a lower density (or larger diameter) than in the final rod shape after having entirely passed the rod-forming process. Preferably, upon passing the upstream section of the second stage, the substrate web is gathered at least as much as to at least partially surround the susceptor profile. Thus, the partially surrounding substrate material advantageously provides a supporting embedding of the susceptor profile for preserving the desired position of the susceptor profile.

The second stage of the rod-forming process may further comprise at least one downstream section for completing the step of gathering the substrate web coaxially around the susceptor profile into the final rod shape. Accordingly, the susceptor profile may also be longitudinally guided at least partially along a downstream section of the second stage.

According to a further aspect of the method, the method may comprise the step of crimping the first and second substrate web prior to supplying the first and second substrate web to the continuous rod-forming process. In particular, each of the first and the second substrate web may be crimped longitudinally. That is, the respective substrate web may be provided with a longitudinal folding structure along a longitudinal axis of the web, that is, along a transport direction of the substrate web. Preferably, the longitudinal folding structure provides the substrate with a zigzag or wave-like cross section. Advantageously, crimping each of the first and the second substrate web facilitates the step of gathering both substrate webs in a transverse direction with respect to their longitudinal axis into the final rod shape. In particular, the longitudinal folding structure supports proper folding of the aerosol-forming substrate around the susceptor. This proves advantageous for manufacturing aerosol-forming rods with reproducible specifications. However, in some embodiments, only one of the first and second substrate webs may be crimped.

Preferably, the continuous susceptor profile is a continuous susceptor sheet, for example a band. The continuous susceptor sheet may be provided on a bobbin. As used herein, the term 'continuous susceptor sheet' refers to a continuous susceptor profile having an oblong or flat cross-section, in particular a rectangular cross-section. That is, the continuous susceptor sheet has a cross-sectional width extension larger than a cross-sectional thickness extension. Preferably, a width extension is 10 to 250, in particular 50 to 150, preferably 60 to 120 times larger than a thickness extension. For example, the continuous susceptor sheet may have a width extension between 2 millimeters and 6 millimeters, in particular between 3 millimeters and 5 millimeters, and a thickness extension between 20 micrometers and 70 micrometers, in particular between 25 micrometers and 60 micrometers.

Preferably, a width extension of the susceptor sheet corresponds to a width extension of the susceptor in the final product. The susceptor sheet advantageously provides heat in a highly sufficient manner because the oblong or flat cross-section of the susceptor sheet yields an advantageous ratio between the susceptor volume and the heat releasing susceptor surface. In particular, heat may be provided over the entire diameter and along the entire length of the aerosol-forming rod.

In case the susceptor is provided as a continuous sheet, the continuous susceptor sheet may be supplied such as to enter and pass through at least the second stage of the rod-forming process having a large or flat side of the continuous susceptor sheet arranged either substantially horizontally or substantially vertically.

As used herein, the terms 'substantially vertical", 'substantially horizontal" and 'substantially orthogonal' also include deviations of up to 20 degrees from a respective vertical, horizontal and orthogonal orientation.

In particular, a respective flat side of the continuous susceptor sheet faces a respective flat side of each of the first and second substrate web prior to pre-gathering or gathering the first and second substrate web in the first or second stage, respectively. That is, the susceptor sheet is substantially co-planar to the first and second substrate webs prior to pre-gathering or gathering the substrate webs. Advantageously, a symmetric supply of the first and second substrate webs around the susceptor sheet stabilizes the desired final position of the susceptor which in turn reduces the variability of the product performance. Preferably, the respective flat sides of the substrate webs and the susceptor sheet are arranged substantially horizontally prior to pre-gathering or gathering the substrate webs in the first or second stage, respectively. Of course, the respective flat sides of the substrate webs and the susceptor sheet may alternatively be arranged substantially vertically prior to pre-gathering or gathering the substrate webs in the first or second stage, respectively.

The first and second substrate webs may be a starting material of the method according the invention. In particular, the first and second substrate webs may be each provided on a separate bobbin. Where more than one bobbin is utilized the bobbins may contain the same aerosol-generating material. Alternatively, the bobbins may contain the aerosol-generating material may differ from each other, for example in one of composition, flavor, texture or combinations thereof.

Alternatively, the method according to the invention may comprise the steps of cutting and separating a master substrate web lengthwise into at least two, in particular into the first and the second substrate webs prior to supplying the respective substrate webs to the continuous rod-forming process.

According to a further aspect of the method, the method may comprise the step of supplying a wrapper to the rod-forming process and wrapping the wrapper around the substrate web. The wrapper may help to stabilize the shape of the aerosol-forming rod. It may also help to prevent an inadvertent disassociation of the substrate webs and the susceptor profile. For example, the wrapper may be a paper wrapper, in particular a paper wrapper made of cigarette paper. Alternatively, the wrapper may be a foil, for example made of metal, plastics or cellulose material. Preferably, the wrapper is fluid permeable or has been made, at least locally, fluid permeable such as to allow vaporized aerosol-forming substrate to be released from the article. The wrapper may be porous. Furthermore, the wrapper may comprise at least one volatile substance to be activated and released from the wrapper upon heating. For example, the wrapper may be impregnated with a flavoring volatile substance. Preferably, the step of supplying a wrapper to the rod-forming process and wrapping the wrapper around the substrate webs is performed downstream of the first stage, in particular downstream of an upstream section of the second stage.

Downstream the rod-forming process, the method provides a continuous inductively heatable aerosol-generating rod. Preferably, the continuous rod has a circular or oval or elliptical outer cross-section. However, the continuous rod may also have a rectangular or square or triangular or polygonal cross-section.

According to yet a further aspect of the method, the method comprises the step of cutting the continuous rod into inductively heatable rod segments. Preferably, the rod segments are of equal length. A length of the segments may be varied, depending on the consumable or inductively heatable smoking article to be manufactured using such an inductively heatable rod segment. Preferably, cutting is performed without reorientation of the continuous rod. Advantageously, cutting is performed in a vertical direction. Preferably, the susceptor profile is positioned and oriented in the continuous rod such that no deformation of the susceptor occurs during cutting.

The aerosol-forming rods or rod segments may be used to form an inductively heatable aerosol-generating article. As used herein, the term 'aerosol-generating article' refers to an article comprising an aerosol-forming substrate to be used with an aerosol-generating device. The aerosol-generating article may be a tobacco article. In particular, the article may be a rod-shaped article resembling conventional cigarettes. Apart from the aerosol-forming rod (rod segment), the aerosol-generating article may further comprise at least one of a support element, an aerosol-cooling element, a filter element and a mouthpiece element. Any one or any combination of these elements may be arranged sequentially to the aerosol-forming rod segment. These elements may have the same outer cross-section as the aerosol-forming rod segment. In particular, the aerosol-forming rod segment and any one or any combination of the above elements may be arranged sequentially and circumscribed by an outer wrapper to form a rod-shaped article.

According to the invention there is also provided an apparatus for manufacturing inductively heatable aerosol-forming rods. Preferably, the apparatus is configured for performing the method according to the invention and as described herein.

The apparatus according to the invention comprises a multi-stage rod-forming device comprising at least a first and a second stage, wherein the second stage is located downstream of the first stage. The first stage comprises a first pre-gathering unit and a second pre-gathering unit. Each of the first pre-gathering unit and the second pre-gathering unit is configured for separately pre-gathering a first substrate web and a second substrate web respectively as each of the first and second web passes through the first stage. The first substrate web and the second substrate web are pre-gathered in a transverse direction with respect to the transport directions of the first and second substrate web through the first stage. The second stage is configured for jointly gathering the pre-gathered first substrate web and second substrate web into a rod shape around a susceptor profile as the susceptor profile and the pre-gathered first substrate web and second substrate web pass through the second stage.

The apparatus according to the invention further comprises a susceptor supply configured for supplying the continuous susceptor to the rod-forming device such as to pass through at least the second stage. In addition, the apparatus according to the invention comprises a substrate supply configured for supplying the first substrate web and second substrate web to the rod-forming device. In particular, the substrate supply is configured for supplying the first and second substrate web to the rod-forming device such as to enter and pass through the first stage and second stage in succession.

According to a preferred aspect of the invention, a downstream end of the first stage may extend into an upstream end of the second stage. Advantageously, this nested arrangement of the first and second stage provides a compact design of the apparatus and also a smooth transition between the first and the second stage.

Preferably, first stage comprises a first pre-gathering unit and a second pre-gathering unit. The first pre-gathering unit is configured for pre-gathering the first substrate web in a transverse direction with respect to the transport direction of the first substrate web through the first pre-gathering unit. Likewise, the second pre-gathering unit is configured for pre-gathering the second substrate web in a transverse direction with respect to the transport direction of the second substrate web through the second pre-gathering unit.

The first stage, in particular the first pre-gathering unit, may comprise a first funnel for pre-gathering the first substrate web. Likewise, the first stage, in particular the second pre-gathering unit, may comprise a second funnel for pre-gathering the second substrate web. In particular, the first and the second funnel of the first stage are separate funnels. Each of the first and the second funnel is configured for gathering the respective substrate web in a transverse direction with respect to a transport direction of the respective substrate web through the first stage, that is, in a transverse direction with respect to a longitudinal axis of the respective substrate web. For this, each of the first and the second funnel preferably has an inner cross-section which progressively decreases downstream and thus causes the respective substrate web to be progressively gathered in a transverse direction with respect to its transport direction.

Advantageously, the first and the second funnel are positioned laterally offset, in particular laterally offset at opposite sides with regard to a center axis of the second stage. This arrangement enables the susceptor profile to pass through the first stage between the first and second substrate web, in particular without contact to the first and the second substrate web. Likewise, this arrangement also enables the susceptor profile to enter the second stage between the first and the second substrate web, or vice versa, enables the first and second substrate web to enter the second stage of the rod-forming process laterally to the susceptor profile. Either way, this arrangement proves advantageous with regard to a symmetric gathering of the first and second substrate web around the susceptor profile in the second stage.

The first and the second funnel may be arranged and configured such that each of the first and the second substrate web enters the second stage alongside the susceptor profile at an angle between zero degrees and 50 degrees, in particular between zero degrees and 30 degrees, preferably between zero degrees and 20 degrees with regard to a transport direction of the susceptor profile. Accordingly, a respective center axis of the first and the second funnel may be arranged at an angle between zero degrees and 50 degrees, in particular between zero degrees and 30 degrees, preferably between zero degrees and 20 degrees with regard to a transport direction of the susceptor profile through the second stage, in particular with regard to a center axis of the second stage. Moreover, a respective center axis of the first and the second funnel may point from a side towards a center axis of the second stage, that is, at an angle greater than zero degrees with regard a center axis of the second stage. Having the first and the second funnel pointing towards a center axis of the second stage advantageously facilitates the gathering of the first and second substrate web around the susceptor. Alternatively, the first and the second funnel may be arranged and configured such that the first and second substrate web enter the second stage parallel to the susceptor profile, that is, at an angle of zero degrees to a transport direction of the susceptor profile, in particular to the center axis of the second stage.

Advantageously, each of the first and the second funnel comprises a low friction surface material, for example, a plastic or polished metal surface. This reduces the risk of material weakening or even rupture of the first and second substrate web. Furthermore, less friction also reduces vibrations of the first and second substrate as passing through the first and second funnel, respectively. Otherwise higher friction could cause the susceptor profile to deviate from its desired position upon getting into contact with the first and second substrate web.

According to another aspect of the invention, the first stage may comprise a pre-gathering element having a first convex guide surface and a second convex guide surface, wherein each guide surfaces converges towards the second stage. The convex curvature of the first convex guide surface and second convex guide surface is bowed outward with respect to the center axis of the gathering process. The first convex guide surface and second convex guide surface are located closer to the center axis of the gathering process than the first substrate web and second substrate web when passing over the first and second guide surface, respectively. The first guide surface is arranged and configured for pre-gathering the first substrate web as passing over the first guide surface towards the second stage. Likewise, the second guide surface is arranged and configured for pre-gathering the second substrate web as passing over the second guide surface towards the second stage. Advantageously, the first and second convex guide surface cause the first and second substrate web to be pre-shaped such as to have a curved or half-moon cross-sectional profile. A curved or half-moon cross-sectional profile advantageously facilitates the subsequent step of gathering both substrate webs around the susceptor profile in the second stage.

Preferably, the first and the second convex guide surface are positioned laterally offset, in particular laterally offset at opposite sides with regard to a center axis of the second stage of the rod-forming device. Preferably, the pre-gathering element comprises a sleeve having a tapered outside surface including the first convex guide surface and second convex guide surface. The offset arrangement, especially the sleeve configuration of the pre-gathering element advantageously enables the susceptor profile to pass through the pre-gathering element between the first convex guide surface and second convex guide surface, in particular without contact to the first substrate web and the second substrate web. This further facilitates the susceptor profile to enter the second stage between the first substrate web and the second substrate web. Preferably, the tapered outside surface of the sleeve is conical. Likewise, the entire sleeve may be conical or frustum-shaped.

Advantageously, each of the first and the second guide surface comprises a low friction surface material, for example, a plastic or polished metal surface. This reduces the risk of material weakening or even rupture of the first and second substrate web. Furthermore, less friction also reduces vibrations of the first and second substrate as passing over the first and second guide surface, respectively.

Furthermore, the pre-gathering element may comprise at least one separating fin extending between the first and second convex guide surface towards the second stage. Preferably, the pre-gathering element comprises two separating fins extending at opposite sides of the pre-gathering element between first and second convex guide surface towards the second stage.

In particular, the one or more separating fins may extend in a length direction of the pre-gathering element, preferably substantially along a transport direction of the first and second substrate web as passing over the first and second guide surface towards the second stage.

The at least one separating fin facilitates to pre-gather the first and second substrate web transversely with respect to a respective transport direction of the first and second substrate web as passing over the first and second guide surface towards the second stage. Furthermore, the at least one separating fin serves to keep the first and second substrate web separated from each other before entering into the second stage.

According to another aspect of the invention, the second stage of the rod-forming device may comprise a funnel or semi-funnel or a combination of both, a funnel and semi-funnel. In the latter case, an upstream section of the second stage preferably comprises a funnel, whereas a downstream section preferably comprises a semi-funnel.

Advantageously, the semi-funnel comprises a rod-forming concave surface that remains open along a longitudinal axis of the funnel. The concave surface preferably has a C-shaped or U-shaped cross-section. For example, the semi-funnel is one half of a 'full' funnel.

The funnel and the semi-funnel may be configured such as to have an inner cross-section which progressively decreases downstream and thus causes the substrate web to be progressively gathered and compressed around the susceptor profile.

Advantageously, each of the funnel and the semi-funnel comprises a low friction surface material, for example, a plastic or polished metal surface, to get into contact with the first and second substrate web. This reduces the risk of material weakening or even rupture of the first and second substrate web. Furthermore, less friction also reduces vibrations of the first and second substrate as passing through the second stage.

The second stage, in particular, the downstream section of the second stage may further comprise a conveyor belt, typically called garniture tape, which preferably interacts with the at least one semi-funnel to form the final rod shape. For this, the garniture tape may progressively take a cross-sectional U-shape along the second stage or the downstream section. Preferably, the garniture tape is arranged below a center axis of the second axis. The at least one semi-funnel is arranged above the center axis and thus above the garniture tape.

In operation, the U-shaped garniture tape in combination with the semi-funnel gathers the substrate web coaxially around the susceptor profile into the final rod shape.

The garniture tape may further support a wrapper. The wrapper may be supplied by a wrapper supply into an upstream end of the second stage or into a downstream section of the second stage. The wrapper supply may for example include a wrapper bobbin. Preferably, the wrapper is supported on a surface of the garniture tape which faces the center axis. Thus, in operation the wrapper is automatically wrapped around the substrate web as the latter is progressively gathered around the susceptor profile into the final rod shape. The wrapper supply may also add glue to at least a portion of the wrapper for keeping the wrapper around the substrate.

According to preferred aspect of the invention, the apparatus may comprise a longitudinal guide for guiding the continuous susceptor profile along at least a section of the rod-forming device. In general, the longitudinal guide serves to stabilize and enhance the accuracy of the positioning of the susceptor profile its desired final position within the aerosol-generating rod. The longitudinal guide may be part of the susceptor supply.

The longitudinal guide may be arranged and configured for guiding the susceptor profile at least along 25 percent, in particular at least along 50 percent, preferably at least along 75 percent, more preferably at least along 90 percent or along 100 percent of a length of the rod-forming device. For this, the longitudinal guide may extend at least along 25 percent, in particular at least along 50 percent, preferably at least along 75 percent, more preferably at least along 90 percent or along 100 percent of a length of the rod-forming device. Preferably, the longitudinal guide serves for guiding the susceptor profile along a center axis of the second stage through at least an upstream section of the second stage. In particular, the longitudinal guide may extend throughout the entire upstream section of the second stage.

At least a portion of the longitudinal guide may be also arranged upstream of the second stage such as to facilitate pre-positioning the susceptor profile along the center axis of the second stage prior to entering the second stage. Preferably, the longitudinal guide extends through the entire first stage, in particular in addition to extending through at least the upstream section of the second stage of the rod-forming device. Moreover, at least a portion of the longitudinal guide may be also arranged upstream of first stage and, thus, upstream of the rod-forming device. Accordingly, an upstream end of the longitudinal guide may be positioned upstream of an upstream end of the rod-forming device. This further facilitates pre-positioning the susceptor profile along the center axis, even prior to entering the rod-forming device. Advantageously, this further ensures an accurately position of the susceptor profile its desired final position within the aerosol-generating rod.

Advantageously, a downstream end of the longitudinal guide is positioned at a downstream end of the upstream section of the second stage or further downstream of the upstream section of the second stage, that is, in a downstream section of the second stage. There, the gathering process of the first and the second substrate web is further progressed such that the first and second substrate webs advantageously are in contact with each other. Consequently, any pressure and friction effects of the first and second substrate webs on the susceptor profile are substantially symmetric. Accordingly, the susceptor profile preferably is at least partially surrounded and supported by the first substrate web and second substrate web. The first substrate web and second substrate web advantageously stabilize the position of the susceptor profile. Vice versa, upstream of the downstream section of the second stage, the longitudinal guide advantageously protects the susceptor profile from any asymmetric and thus unbalanced pressure and friction effects of the first and second substrate webs.

The longitudinal guide may comprise a guiding tube, for example a tube or a sleeve having both ends open. Alternatively, the longitudinal guide may comprise a rod-like trail having a longitudinal groove for guiding the susceptor profile in the groove.

At its downstream end, the rod-forming device provides a continuous aerosol-forming rod having the final rod-shape in which the substrate web is fully gathered around the susceptor profile and preferably also entirely surround by a wrapper.

Downstream of the rod-forming device, the apparatus may further comprise a cutting device for cutting the continuous rod into inductively heatable aerosol-forming rod segments.

The apparatus may further comprise a strip cutter for cutting a master substrate web lengthwise at least into the first and second substrate webs. The strip cutter is arranged upstream of the rod-forming device.

Further features and advantages of apparatus according to the invention have been described with regard to method and will not be repeated.

In principle, the method and the device according to the invention could also be used to place any element other than the susceptor profile into the aerosol-forming rod, for example, capsules, adsorbents, or a thread.

Figure 2:
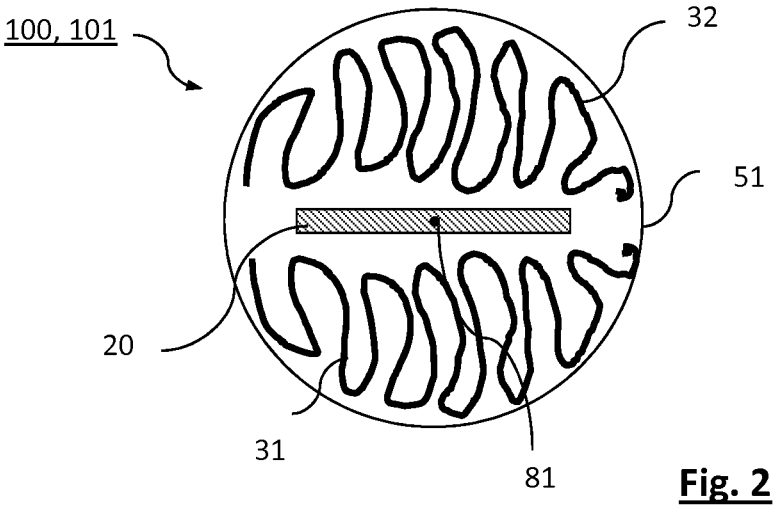
Figure 3:
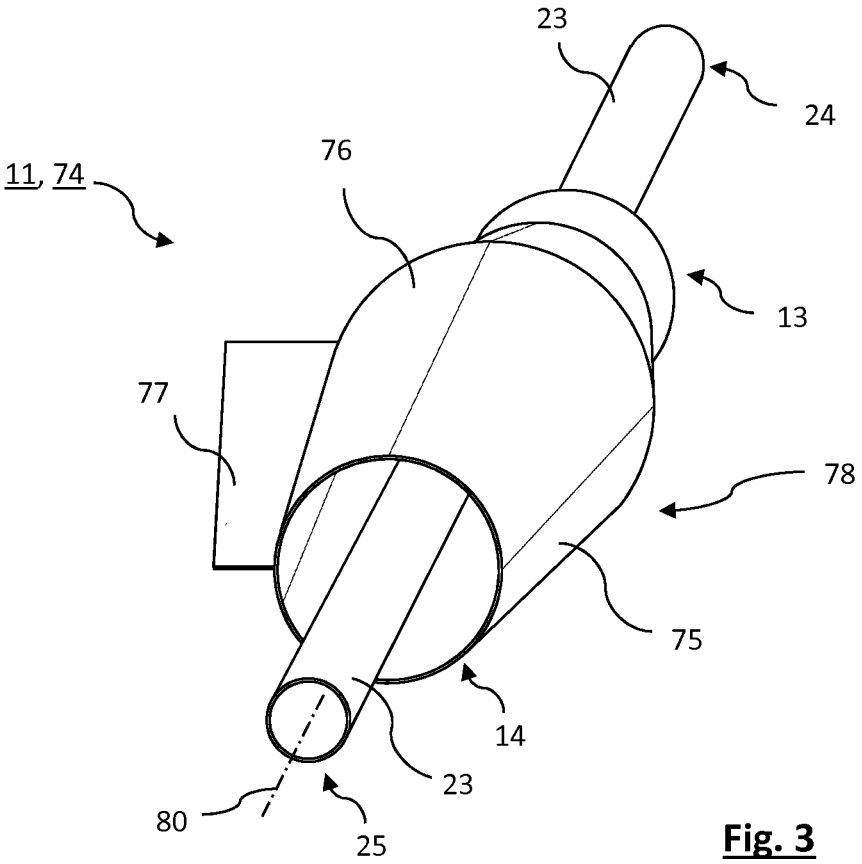
Figure 4:
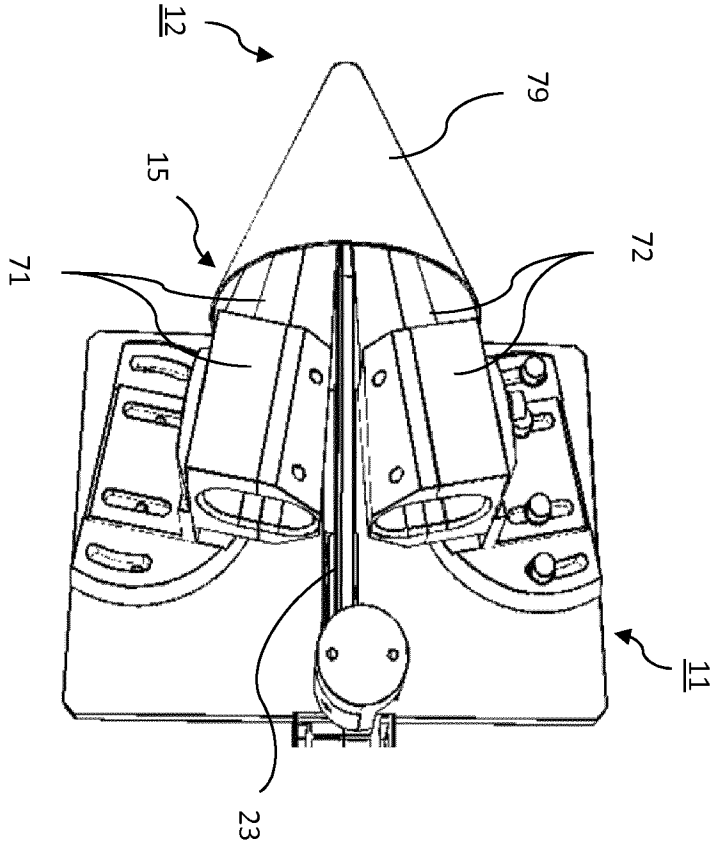
Figure 5:
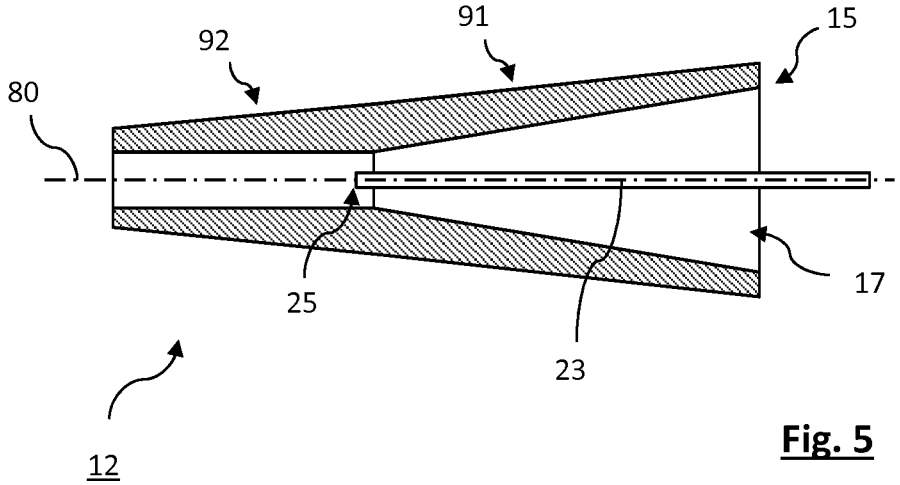

The invention will be further described, by way of example only, with reference to the accompanying drawings, in which:

FIG. 1 schematically illustrates an exemplary embodiment of an apparatus according to the invention comprising a multi-stage rod-forming device having a first and a second stage;

FIG. 2 is a schematic cross-sectional view of an aerosol-forming rod manufactured by using the method and the apparatus according to the invention;

FIG. 3 schematically illustrates an alternative embodiment of the first stage of the rod-forming device according to FIG. 1;

FIG. 4 schematically illustrates a modification of the rod-forming device according to FIG. 1; and FIG. 5 schematically illustrates another modification the rod-forming device according to FIG. 1.

FIG. 1 schematically illustrates an exemplary embodiment of an apparatus 1 according to the invention. The apparatus 1 is configured for manufacturing aerosol-forming rods 100 comprising a susceptor profile 20 in the center which a first and a second substrate web 31, 32, each including an aerosol-forming substrate, are coaxially gathered around. The apparatus 1 as shown in FIG. 1 is particularly configured for performing the method according to the invention and as described herein.

Main component of the apparatus 1 is a rod-forming device 10 configured for gathering the first substrate web 31 and the second substrate web 32 around the susceptor profile 20 coaxially to a center axis 80 of the rod-forming device 10, thus resulting in the final rod shape. The rod-forming process is a continuous process. That is, the first and second substrate webs 31, 32 and the susceptor profile 20 enter and pass the rod-forming device 10 as continuous materials. Accordingly, gathering of the first and second substrate webs 31, 32 around the susceptor profile 20 occurs as the substrate webs 31, 32 and the susceptor profile 20 together pass through the rod-forming device 10. The center axis 80 also defines a transport line through the rod-forming device 10.

Upstream of the rod-forming device 10, the apparatus 1 comprises a first and a second substrate supply 35, 36 (generally symbolized by the upper and lower arrow on the right side of FIG. 1) for supplying the first and the second substrate web 31, 32 downstream towards the upstream end 13 (entrance) of the rod-forming device 10. The first and second substrate webs 31, 32 preferably are continuous tobacco webs, for example cast leaf. Each one of the first and second substrate web 31, 32 enters the rod-forming device 10 as substantially flat material. As can be seen from FIG. 1, the first substrate web 31 is supplied such as to enter the rod-forming device 10 below the center axis 80, whereas the second substrate web 32 is supplied such as to enter the rod-forming device 10 above the center axis 80. In particular, the flat sides of each one of the first and second substrate web 31, 32 are arranged substantially horizontally when entering the rod-forming device 10. As, described above, supplying the substrate material in form of a first and a second substrate web 31, 32 advantageously allows for pre-distributing the substrate material around the susceptor profile 20. This in turn positively affects the subsequent step of gathering the substrate material around the susceptor profile 20, in particular substantially symmetrically.

The apparatus 1 further comprises a susceptor supply 21 (generally symbolized by the central arrow on the right side of FIG. 1) for supplying the continuous susceptor profile 20 downstream towards the rod-forming device 10. In the present embodiment, the susceptor profile 20 is a continuous sheet 20 of a susceptor material having a rectangular cross-section, such as a continuous band made of ferromagnetic stainless steel. The susceptor profile 20 may be provided, for example, on a bobbin (not shown) which is part of the susceptor supply 21. The susceptor profile 20 is unwound from the bobbin and supplied towards the center axis 80 upstream of the rod-forming device 10.

According to the invention, the rod-forming device 10 is a multi-stage rod-forming device 10. In the present embodiment, the device 10 comprises a first stage 11 and a second stage 12, the latter being located downstream of the first stage 11. The first stage 11 is configured for separately pre-gathering the first substrate web and the second substrate web 31, 32 in a transverse direction with respect to the transport directions of the first and second substrate web 31, 32 through the first stage 11 as both substrate webs 31, 32 pass through the first stage 11. The second stage 12 is configured for jointly gathering the pre-gathered first and second substrate webs 31, 32 into a rod shape around the susceptor profile 20 as the susceptor profile 20 and the pre-gathered substrate webs 31, 32 pass through the second stage 12.

In the present embodiment of the rod-forming device 10, the first stage 11 comprises a first and a second pre-gathering unit 71, 72. The first pre-gathering unit 71 is arranged below the center axis 80 and configured for pre-gathering the first substrate web 31 in a transverse direction with respect to its transport direction through the first pre-gathering unit 71. Likewise, the second pre-gathering unit 72 is arranged above the center axis 80 and configured for pre-gathering the second substrate web 32 in a transverse direction with respect to its transport direction through the second pre-gathering unit 72. As can be seen from FIG. 1, each of the first and second pre-gathering unit 71, 72 comprises a frustum-shaped funnel 71, 72. A circular inner cross-sectional profile of the respective funnel 71, 72 continuously decreases from an upstream end 13 of the first stage 11 towards a downstream end 14 of the first stage 11. Each funnel 71, 72 pre-gathers the respective substrate web 31, 32 transversely with respect to its length extension. Upon having passed the first stage 11, the first and the second substrate webs 31, 32 are pre-gathered but have not yet assumed the final rod shape. As described further above, pre-gathering of the first and second substrate web 31, 32 causes friction effects and a resistance to compression of the substrate material to be less pronounced during the actual rod-forming process in the second stage 12. Advantageously, this not only increases the overall efficiency of the rod-forming process but also facilitates an accurate positioning of the susceptor 20 at a pre-defined position within the aerosol-forming rod. In particular, the pre-gathered substrate webs 31, 32 provide a supporting embedding of the susceptor profile in the second stage 12. Furthermore, pre-gathering also reduces the risk of plastic deformations of the susceptor profile 20.

As can be further seen from FIG. 1, the susceptor profile 20 is supplied to the rod-forming device 10 such as to enter and pass both, the first and the second stage 11, 12 of the rod-forming device 10, along the center axis 80. Due to the central positioning, the susceptor profile 20 is accurately placed at its desired final position within the aerosol-generating rod 100, that is, coaxially to, in particular on-axis with a center axis of the aerosol-generating rod 100. In particular, the susceptor profile 20 is positioned along the center axis 80 having the flat sides of the susceptor profile 20 arranged substantially horizontally. Also, the susceptor profile 20 is positioned on-axis with regard to the center axis 80 of the rod-forming device 10. That is, a longitudinal axis of the susceptor profile 20 extending through a center of mass or a geometric center of the susceptor profile 20 is coaxial to the center axis 80 of the rod-forming device 10.

Since the susceptor profile 20 also enters and passes the first stage 11 along the center axis 80, the susceptor profile 20 is already pre-positioned on-axis prior to entering the second stage 12, that is, prior to getting into contact with the pre-gathered first and second substrate web 31, 32. Thus, the pre-positioned susceptor profile 20 defines a physical center for the rod-forming process which the first and the second substrate web 31, 32 are coaxially gathered around. Advantageously, this causes the rod-forming process to be reliable and reproducible with regard to an accurate center position of the susceptor within the surrounding substrate.

As described above, the first and second substrate web 31, 32 are supplied such as to pass the first stage 11 and to enter the second stage 12 below and above the center axis 80, respectively. Thus, each of the pre-gathered first and second substrate web 31, 32 enters the second stage 12 laterally to the susceptor profile 20. Advantageously, this ensures that there is little or essentially no divergence of the susceptor profile 20 from its pre-defined on-axis position upon entering the second stage. In particular, each of the pre-gathered first and second substrate web 31, 32 enters the second stage 12 from below or above, respectively, towards the susceptor profile 20, that is, at an angle greater than zero degrees to the center axis 80, for example at an angle of 5 degrees. In particular, having the pre-gathered first substrate web 31 arranged substantially horizontally below the susceptor profile 20 advantageously supports the susceptor profile 20 when passing through the second stage 12. This also facilitates to keep a stable position of the susceptor profile 20 along the center axis 80.

In order to prevent the susceptor profile 20 from being displaced from the center axis 80 as passing through the rod-forming device 10, the apparatus 1 further comprises a longitudinal guide 23 for guiding the susceptor profile 20 along the center axis 80. In the present embodiment, the longitudinal guide is a guiding tube 23 extending coaxially to the center axis 80 through the entire first stage 12 in between the first and second pre-gathering units 71, 72.

The guiding tube 23 also extends in the upstream direction beyond an upstream end 13 of the first stage 11. That is, an upstream end 24 of the guiding tube 23 is positioned upstream of the funnels 71, 72. Advantageously, this supports an accurate pre-positioning and guiding of the susceptor profile 20 along the center axis 80 prior to entering the rod-forming device 10.

Advantageously, the guiding tube 23 ends at a position downstream of the first stage 11 where the susceptor profile 20 preferably is at least partially surrounded by the pre-gathered first and second substrate webs 31, 32. In the present embodiment as shown in FIG. 1, a downstream end 25 of the guiding tube 23 is positioned adjacent to an upstream end 15 of the second stage 12.

The second stage 12 of the rod-forming device is configured for completing the step of gathering the pre-gathered first and second substrate web 31, 32 coaxially around the susceptor profile 20 into the final rod shape. In the present embodiment, the second stage 12 comprises a semi-funnel 73 arranged above the center axis 80 which comprises a rod-forming concave surface having a C-shaped cross-section. The C-shaped cross-section progressively decreases in size downstream from the upstream end 15 to a downstream end 16 of the second stage 12. The second stage 12 further comprises a conveyor belt 17, in the present embodiment a garniture tape 17, which interacts with the semi-funnel 73 to form the final rod shape. For this, the garniture tape 17 progressively takes a cross-sectional U-shape as it runs along the second stage 12 downstream below the center axis 80. In operation, the U-shaped garniture tape 17 in combination with the semi-funnel 72 gathers the pre-gathered first and second substrate web 31, 32 coaxially around the susceptor profile 20 into the final circular rod shape.

In addition, a paper wrapper 51 is supplied from a wrapper supply 50 into the upstream end 15 of the second stage 12. As can be seen from FIG. 1, the wrapper 51 is supported on a top surface of the garniture tape 17 which faces the center axis 80. Thus, in operation the wrapper 51 is automatically wrapped around the first and second substrate web 31, 32 as the latter are progressively gathered around the susceptor profile 20. Preferably, glue is added to at least one longitudinal edge of the wrapper 51 for connecting both longitudinal edges of the wrapper upon being wrapped around the rod-shaped material of the first and second substrate web 31, 32. Thus, the wrapper 51 serves to stabilize the final rod shape. For adding glue and connecting the longitudinal edges of the wrapper 51, the rod-forming device 10 according to the present embodiment comprises a folding and compressing device 18 downstream of the second stage 12.

At a downstream end 19 of the overall rod-forming device 10, the device 10 provides a continuous aerosol-forming rod 100 having the final rod-shape in which the first and the second substrate webs 31, 32 are fully gathered around the susceptor profile 20 and entirely surround by the wrapper 51.

Downstream of the rod-forming device 10, the apparatus 1 further comprises a cutting device 60 for cutting the continuous rod 100 into inductively heatable aerosol-forming rod segments 101.

FIG. 2 shows a cross-sectional view of a continuous aerosol-forming rod 100 or rod segment 101, respectively, manufactured using the apparatus and the method as illustrated in FIG. 1 and described before. The circular cross-section of the rod shape may have a diameter between about 4 millimeters and about 10 millimeters, in particular, between about 5 millimeters and about 8 millimeters. The rectangular shape of the susceptor profile 20 preferably has a width extension between about 2 millimeters and about 8 millimeters, in particular between about 3 millimeters and about 5 millimeters, and a thickness extension between about 0.03 millimeter and about 0.15 millimeter, more preferably between about 0.05 millimeter and about 0.09 millimeter.

Due to the fact that the substrate material is supplied and processed in two parts, that is, in the form of the first and second substrate web 31, 32, the substrate material is substantially symmetrically gathered around both flat sides of the susceptors profile 20. As a result, the susceptor profile 20 is positioned substantially symmetrically with regard to a center 81 of the circular cross-section of the rod-shape, as can be seen in FIG. 2. This position is preferred with regard to a homogeneous, in particular symmetric and reproducible heat distribution in the aerosol-generating rod. Thus, heat generated in the susceptor profile 20 symmetrically dissipates into the circumferential periphery of the susceptor profile 20 allowing to homogeneously heat-up the aerosol-forming substrate of the substrate webs 31, 32 gathered around.

FIG. 3 shows an alternative embodiment of the first stage 11 of the rod-forming device 10. Instead of the funnel-like first and second pre-gathering units 71, 72, the first stage 11 of the embodiment shown in FIG. 3 comprises a pre-gathering element 74. The pre-gathering element 74 comprises a sleeve having a tapered downstream portion 78. An outside surface of the tapered downstream portion 78 includes a first convex guide surface 75 and a second convex guide surface 76 which correspond to the outside surface of the lower and upper half of the downstream portion 78 of the sleeve. Each guide of the surfaces 74, 75 converges towards a downstream end 14 of the first stage 11 and is bowed outward with respect to the center axis 80 of the gathering process. The first guide surface 75 is arranged and configured for pre-gathering the first substrate web 31 as passing over the first guide surface 31 towards the second stage 12. Likewise, the second guide surface 76 is arranged and configured for pre-gathering the second substrate web 32 as passing over the second guide surface 76 towards the second stage 12. Advantageously, the first and second convex guide surface 75, 76 cause the first and second substrate web 31, 32 to be pre-shaped such as to have a curved or half-moon cross-sectional profile which in turn facilitates the subsequent step of gathering both substrate webs 31, 32 around the susceptor profile 20 in the second stage 12. The sleeve configuration of the pre-gathering element 74 advantageously enables the susceptor profile 20 to pass through the pre-gathering element 74 between the first and second convex guide surface 75, 76, in particular without contact to the first and second substrate web 31, 32. This further facilitates the susceptor profile 20 to enter the second stage 12 between the first and second substrate web 31, 32.

Furthermore, the pre-gathering element 74 comprises a separating fin 77 extending alongside the downstream portion 78 between the first and second convex guide surface 75, 76 towards the second stage 12. In particular, the separating fin 77 extends in a length direction of the pre-gathering element 74, substantially along a transport direction of the first and second substrate web 31, 32 as passing over the first and second guide surface 75, 76 towards the second stage 12. The separating fin 77 facilitates to pre-gather the first and second substrate web 31, 32 transversely with respect to their respective transport direction. Furthermore, the separating fin 77 serves to keep the first and second substrate web 31, 32 separated from each other before entering into the second stage 12. Of course, the pre-gathering element 74 may also comprises two separating fins extending at opposite sides of the pre-gathering element 74.

FIG. 4 shows a modification of the rod-forming device 10 according to FIG. 1 which concerns the transition from the first stage 11 to the second stage 12. According to this embodiment, the first stage 11 comprises a funnel-like first and second pre-gathering unit 71, 72 as described above with regard to FIG. 1. Likewise, a longitudinal guide 23 extends between both gathering units 71, 72 along a center axis 80 of the rod-forming device 10. In addition to the semi-funnel 73 and the garniture tape 17 (not shown in FIG. 4), the second stage 12 comprises a global funnel 79 upstream of the semi-funnel 73 and the garniture tape 17. As can be seen in FIG. 4, a downstream end of the funnel-like first and second pre-gathering units 71, 72, that is a downstream end 14 of the first stage 11, extends into an upstream end of the global funnel 79, that is, into an upstream end 15 of the second stage 12. Advantageously, this nested arrangement of the first and second stage 11, 12 provides a compact design of the apparatus 1. Moreover, the global funnel 79 provides a smooth transition for the susceptor profile and the pre-gathered first and second substrate web when passing from the first stage 11 to the second stage 12. In particular, an upper portion of the global funnel 79 may continuously merge into the semi-funnel 77 of the second stage 12 (not shown). Alternatively, the global funnel 79 may be part of the first stage 11. Of course, the rod-forming forming device 10 according to FIG. 3 comprising the alternative embodiment of the first stage 11 may also comprise a global funnel 79.

FIG. 5 illustrates another modification of the rod-forming device 10 according to FIG. 1 which concerns the longitudinal guide 23. FIG. 5 shows a top view of the lower part of the second stage 12 according to FIG. 1 (without the semi-funnel 73). According to this embodiment, a downstream end 25 of the longitudinal guide 23 is positioned in a downstream section 92 of the second stage 12. There, the gathering process of the pre-gathered first and second substrate web 31, 32 is further progressed such that the pre-gathered first and second substrate web 31, 32 are preferably in contact with each other. As a consequence, the susceptor profile 20 is at least partially surrounded and supported by the first and second substrate web 31, 32 which thus stabilize the position of the susceptor profile 20. Furthermore, any pressure and friction effects of the first and second substrate webs 31, 32 on the susceptor profile 20 are substantially symmetric in the downstream section 92. Due to this symmetry, possible pressure and friction effects are substantially balanced and thus do not adversely affect the shape and position of the susceptor profile 20. Vice versa, upstream of the downstream section 92, in particular in a upstream section 91 of the second stage 12, the longitudinal guide 23 advantageously protects the susceptor profile 20 from any asymmetric and thus unbalanced pressure and friction effects of the first and second substrate webs 31, 32. As can be further seen in FIG. 5, the garniture tape 17 has progressively taken a constant cross-sectional U-shape in the downstream section 92. Of course, the rod-forming forming device 10 according to FIG. 3 comprising the alternative embodiment of the first stage 11 may also comprise a longitudinal guide 23 having a downstream end 25 positioned in a downstream section 92 of the second stage 12.

Any surface of the first and second stage 11, 12 which gets into contact with the first and second substrate web 31, that is, the inner surface of the funnels 71, 72, the semi-funnel 73, the global funnel 79 and the first and second guide surface 75, 76 of the pre-gathering element 74, preferably comprises a low friction surface material, for example, a plastic or polished metal surface. This reduces the risk of material weakening or even rupture of the first and second substrate web 31, 32. Furthermore, less friction also reduces vibrations of the first and second substrate 31, 32 as passing through the first and second stage 11, 12.

The invention claimed is:

1. Method for manufacturing inductively heatable aerosol-forming rods, the method comprising the steps of:

supplying a first substrate web and a second substrate web separately to a continuous multiple-stage rod-forming process, the multiple-stage rod-forming process including at least a first and a subsequent second stage;

supplying a continuous susceptor profile to the rod-forming process such as to pass through at least the second stage;

passing the first and second substrate web separately through the first stage, thereby separately pre-gathering the first and second substrate web in a transverse direction with respect to a respective transport direction of the first and second substrate web through the first stage; and passing the susceptor profile and the pre-gathered first and second substrate web through the second stage, thereby jointly gathering the pre-gathered first and second substrate web into a rod shape around the susceptor profile.

2. The method according to claim 1, wherein the step of passing the susceptor profile through the second stage comprises passing the susceptor profile through the second stage at least partially along a center axis of the second stage.

3. The method according to claim 1, wherein supplying the susceptor profile to the rod-forming process comprises supplying the susceptor profile such as to enter the second stage between the first and the second substrate web.

4. The method according to claim 1, wherein supplying the susceptor profile to the rod-forming process comprises supplying the susceptor profile such as to pass through the first stage without contact to the first and the second substrate web prior to passing through the second stage.

5. The method according to claim 1, further comprising the step of longitudinally guiding the susceptor profile along at least an upstream section of the second stage.

6. Apparatus for manufacturing inductively heatable aerosol-forming rods, the apparatus comprising:

a multi-stage rod-forming device comprising at least a first stage and a second stage, wherein the second stage is located downstream of the first stage, wherein the first stage is configured for separately pre-gathering a first substrate web and a second substrate web in a transverse direction with respect to the transport directions of the first and second substrate web through the first stage, as each of the first and second web passes through the first stage, and wherein the second stage is configured for jointly gathering the pre-gathered first substrate web and second substrate web into a rod shape around a susceptor profile as the susceptor profile and the pre-gathered first substrate web and second substrate web pass through the second stage;

a susceptor supply configured for supplying the continuous susceptor to the rod-forming device such as to pass through at least the second stage; and a substrate supply configured for supplying the first substrate web and second substrate web to the rod-forming device.

7. The apparatus according to claim 6, wherein a downstream end of the first stage extends into an upstream end of the second stage.

8. The apparatus according to claim 6, wherein the first stage comprises a first funnel for pre-gathering the first web and a second funnel for pre-gathering the second web.

9. The apparatus according to claim 8, wherein the first and second funnel are positioned laterally offset at opposite sides with regard to a center axis of the second stage of the rod-forming device.

10. The apparatus according to claim 6, wherein the first stage comprises a pre-gathering element having a first convex guide surface converging towards the second stage for pre-gathering the first substrate web as passing over the first guide surface towards the second stage and a second convex guide surface converging towards the second stage for pre-gathering the second substrate web as passing over the second guide surface towards the second stage.

11. The apparatus according to claim 10, wherein the pre-gathering element comprises a sleeve having a tapered outside surface including the first and second guide surfaces.

12. The apparatus according to claim 10, wherein the pre-gathering element comprises at least one separating fin extending between the first and second convex guide surface towards the second stage.

13. The apparatus according to claim 6, wherein the second stage of the rod-forming device comprises at least one of a funnel or a semi-funnel.

14. The apparatus according to claim 6, further comprising a longitudinal guide for guiding the continuous susceptor profile along a center axis of the second stage through at least an upstream section of the second stage.

15. The apparatus according to claim 14, wherein the longitudinal guide extends through the entire first stage and at least through the upstream section of the second stage.

* * * * *